US005732627A

United States Patent [19]

Imamaki

[11] Patent Number: 5,732,627

[45] Date of Patent: Mar. 31, 1998

[54] CYLINDRICAL STAMP

[75] Inventor: Teruo Imamaki, Kasugai, Japan

[73] Assignee: Brother Kogyo Kabushiki Kaisha, Nagoya, Japan

[21] Appl. No.: 746,623

[22] Filed: Nov. 12, 1996

[30] Foreign Application Priority Data

Nov. 20, 1995 [JP] Japan ..... 7-325115

[51] Int. Cl.[6] ..... B41F 5/00

[52] U.S. Cl. ..... 101/328; 101/116; 101/375

[58] Field of Search ..... 101/114, 328, 101/129, 376, 375, 116

[56] References Cited

U.S. PATENT DOCUMENTS 4,796,529 1/1989 Mathes ..... 101/230
5,205,214 4/1993 Seo et al. ..... 101/333
5,577,444 11/1996 Toyama ..... 101/379
5,586,500 12/1996 Takami et al. ..... 101/327

FOREIGN PATENT DOCUMENTS 3-254982 11/1991 Japan .

*Primary Examiner*—Edgar S. Burr
*Assistant Examiner*—Dave A. Ghatt
*Attorney, Agent, or Firm*—Oliff & Berridge, PLC

[57] ABSTRACT

A cylindrical stamp is capable of simply forming a stamp pattern inexpensively. The stamp device includes a ring-like member, an ink impregnated body provided around an outer periphery of the ring-like member and a perforated stencil provided around an outer periphery of the ink impregnated body. The stencil includes a stamp pattern having a portion permitting ink to permeate and a portion prohibiting ink from permeating. A pair of end caps secure the edges of the stencil to securely hold it in place and prevent ink seepage. The end caps easily snap into the ring-like member and provide a pair of axial shafts to assist in rotation.

22 Claims, 3 Drawing Sheets

CYLINDRICAL STAMP

BACKGROUND OF THE INVENTION

1. Field of the Invention

The present invention relates to a cylindrical stamp that is rolled onto a surface to transfer an image.

2. Description of Related Art

Conventionally, it is known to provide a cylindrical stamp in which a pattern is formed on the outer peripheral face of a cylinder.

FIG. 5 is a view showing an example of a conventional cylindrical stamp 8 in which a cylinder 80 made of porous resin is fixed to a shaft 86. The porous resin cylinder 80 is formed by, for example, polyurethane or polyethylene having fine continuous pores that permit ink to permeate.

Further, when the porous resin is heated, the resin becomes molten, and the continuous porosity is suppressed thereby constituting an ink impermeable portion that prohibits ink from permeating. According to the conventional cylindrical stamp 8, the outer peripheral face of the porous resin cylinder 80 is selectively and excessively heated and melted in accordance with a pattern whereby a stamp face comprising an ink permeable portion 83 and an ink impermeable portion 84 is formed.

When stamping is conducted by using the cylindrical stamp 8, the porous resin cylinder 80 is previously impregnated with ink, for example, by a vacuum impregnator. By rolling the stamp 8 on recording paper under this state, ink is transferred from the ink permeable portion 83 onto the recording paper.

Conventionally, the above-mentioned pattern of the cylindrical stamp is formed in the following way. First, a mold having a surface on which recessed portions are formed in accordance with a pattern is fabricated. Then, the mold is heated and is brought into contact with the surface of a porous resin cylinder. Thereby, portions of the outer peripheral face of the porous resin cylinder brought into contact with the mold are melted thereby constituting ink impermeable portions. In the meantime, the continuous foam structure remains at portions of the surface of the porous resin cylinder corresponding to the recessed portions of the mold, thereby constituting ink permeable portions. An example of such a conventional cylindrical stamp is disclosed in Japanese Unexamined Patent Publication No. Hei 3-254982 (1991).

However, according to the above-mentioned cylindrical stamp, it is necessary to prepare a mold exclusively used for each pattern, which increases the manufacturing cost. Furthermore, it is necessary to provide a facility such as a press device to heat a mold and bring it in contact with a porous resin cylinder. Therefore, it is very troublesome and expensive for a private user to fabricate such a cylindrical stamp.

SUMMARY OF THE INVENTION

An object of the present invention is to provide a cylindrical stamp that is capable of being fabricated simply and at low cost.

In order to achieve the above-described and other objects, a cylindrical stamp in accordance with the invention is provided with a shaft portion, an ink impregnated body installed around an outer periphery of the shaft portion and a stamp face member installed around an outer periphery of the ink impregnated body. The stamp face pattern comprises a portion that permits ink to permeate and a portion that prohibits ink from permeating.

It is possible to detachably install a pair of cap members onto the shaft portion that clamp the ink impregnated body and the stamp face member therebetween. Further, the ink impregnated body may be formed such that the outer diameter thereof is maximized at the center in the axial direction and the outer diameter is minimized at both ends thereof in the axial direction.

It is also possible to provide a support shaft that is rotatably held by a handle on each of the pair of cap members. A rim portion for holding each of the outer peripheral edges in the axial direction of the ink impregnated body and the stamp face member may be provided on each of the pair of cap members.

Moreover, it is possible to form the cylindrical stamp such that the shaft portion is hollow and cylindrical portions are formed on the inside face of each member so that the cap members can be attached to the shaft portion by inserting the cylindrical portions from both sides in the axial direction into the hollow portion of the shaft portion.

As explained above, according to the cylindrical stamp of the invention, the stamp face member in which a pattern is formed is wrapped around the cylindrical ink impregnated body. Therefore, a cylindrical stamp capable of simply transferring a pattern can be easily assembled.

According to the cylindrical stamp of the invention, the stamp face member is held in place by being pinched by the pair of cap members that are attachable and detachable on each axial end of the device. Therefore, the stamp face member can be easily held on the ink impregnated body, and the stamp face member can be simply interchanged.

The shape of the outer peripheral face of the cylindrical ink impregnated body is formed in a so-called bulged shape where the outer diameter thereof is maximized at the center in the axial direction of the cylinder and is minimized at the both ends in the axial direction. Therefore, a sufficient pressure is supplied on the surface of the stamp that is brought into contact with recording paper during stamping whereby a sufficient amount of ink is supplied and the pattern is clearly transferred with no defects.

Since the axial support shafts are formed on each of the cap members, an additional axial shaft member is not necessary. This contributes to the reduction in the number of parts and facilitates the attachment of a handle.

Further, the cap members may be formed with the rim portion for holding and overlapping each of the outer peripheries of the ink impregnated body and the stamp face member. Therefore, ink is prevented from oozing out from both ends of the stamp face member onto the stamp surface.

The rim portion is formed to protrude along the outer peripheral face of each of the both ends in the direction of the rotational shaft of the stamp. However since the wrapped stamp face member and the underlying ink impregnated body have a bulged outer peripheral shape, the rim portions do not interfere with stamping.

Further, each of the cap members are attached to the shaft portion by inserting the cylindrical portion formed in each cap member into the hollow portion of the stamp. Therefore, the molding of parts is facilitated, and the integration operation of the stamp is simplified.

BRIEF DESCRIPTION OF THE DRAWINGS

A preferred embodiment of the present invention will be described in detail with reference to the following figures wherein.

DESCRIPTION OF PREFERRED EMBODIMENTS

An explanation will be given of a cylindrical stamp in accordance with the present invention based on preferred embodiments of the invention.

Figure 1:
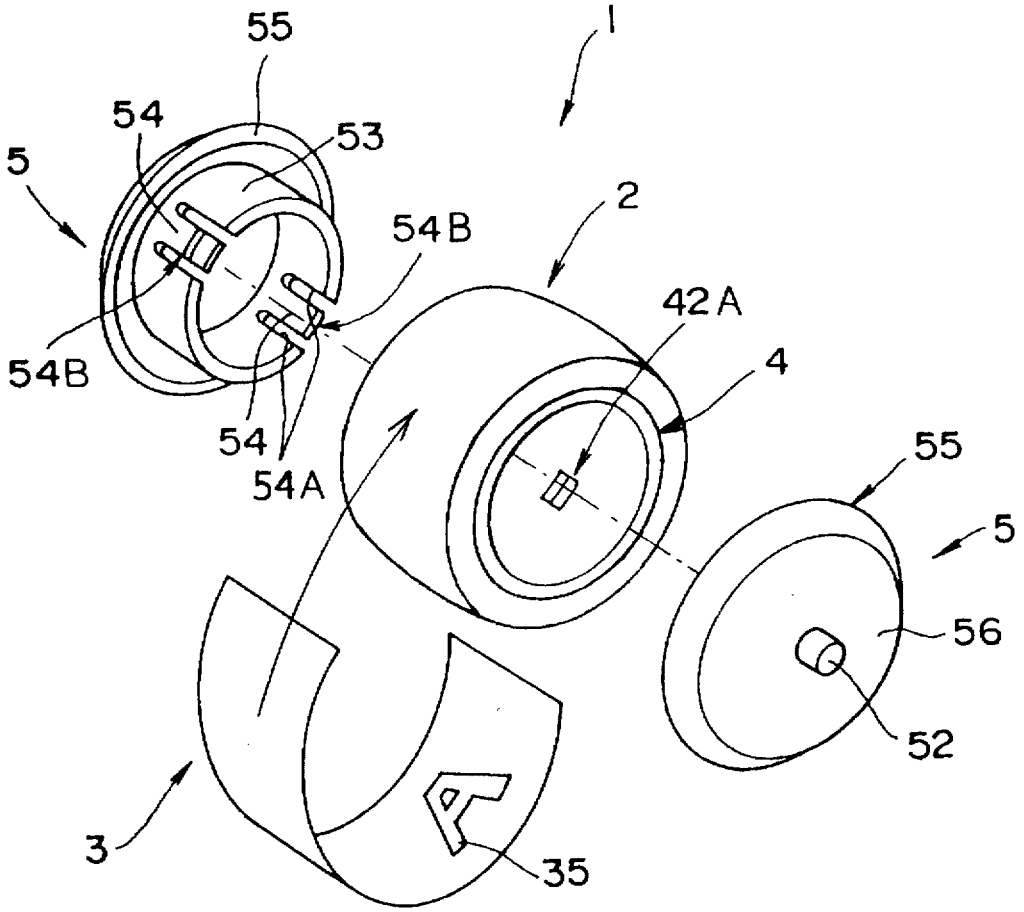
FIG. 1 is an exploded perspective view showing a cylindrical stamp in accordance with an embodiment of the present invention.

FIG. 1 is a view showing a stamp portion 1 of a cylindrical stamp in accordance with the preferred embodiment of the present invention. The stamp portion 1 is provided with an ink impregnated body 2, which is adapted to be impregnated with ink before use. The ink impregnated body 2 is adhered onto the outer periphery of a ring-like member 4 forming a cylindrical shaft of the cylindrical stamp- A perforated stencil 3, which is a stamp face member, is wrapped onto the outer side of the ink impregnated body 2. The perforated stencil 3 is held in a state in which it is wrapped onto the ink impregnated body 2 and secured by a pair of cap members 5, which are fittingly attached onto the ring-like member 4. The ink impregnated body 2 is preferably made of an elastic foamed body made of a synthetic resin material (for example, polyethylene, polypropylene, polyethylene terephthalate, polyurethane and acrylonitrile-butadiene rubber) or unwoven cloth. The impregnated body 2 is preferably impregnated with an oil based ink to the extent of a saturated state. When pressure is applied on the ink impregnated body 2, the ink oozes out.

The ink impregnated body 2 is preferably formed in a shape in which the outer diameter of the central portion is maximized and the outer diameter of the both end portions is minimized in the axial width direction to form a bulbous or barrel shape.

The perforated stencil 3 that is wrapped around the outer periphery of the ink impregnated body 2 is formed of an ink permeable portion and an ink impermeable portion in accordance with a pattern (letter, character, symbol or figure) to be stamped.

Figure 2:
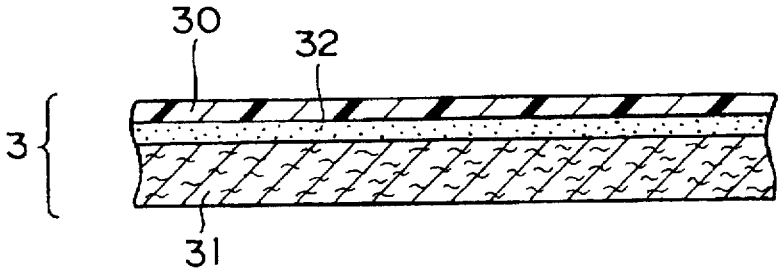
FIG. 2 is a partial side sectional view showing the structure of a perforated stencil.

FIG. 2 is a sectional view explaining the structure of the perforated stencil 3. As shown by FIG. 2 the perforated stencil 3 is formed by adhering a thermoplastic film 30 to a porous supporter 31 through an adhesive agent layer 32.

The thermoplastic film 30 is a film made of a thermoplastic resin material (for example, polyethylene terephthalate, polypropylene and vinilidene chloride-vinyl chloride copolymer) preferably having a thickness of about 1 through 4 μm, preferably about 2 μm.

The porous supporter 31 is a porous thin leaf paper having a major raw material of natural fiber (for example, Manila hemp, kozo fiber and mitsumata fiber), synthetic fiber (for example, polyethylene terephthalate, polyvinyl alcohol and polyacrylonitrile) or semi-synthetic fiber of rayon, for example.

The perforated stencil 3 per se has a property of prohibiting ink from permeating. An ink permeable portion 35 is formed by conducting a perforation treatment that penetrates the thermoplastic film 30, used as a thermosensitive resin, and the adhesive agent layer 32 by radiating infrared ray onto the perforated stencil 3 or by heating it with a thermal head in accordance with desired letters or figures.

Figure 3:
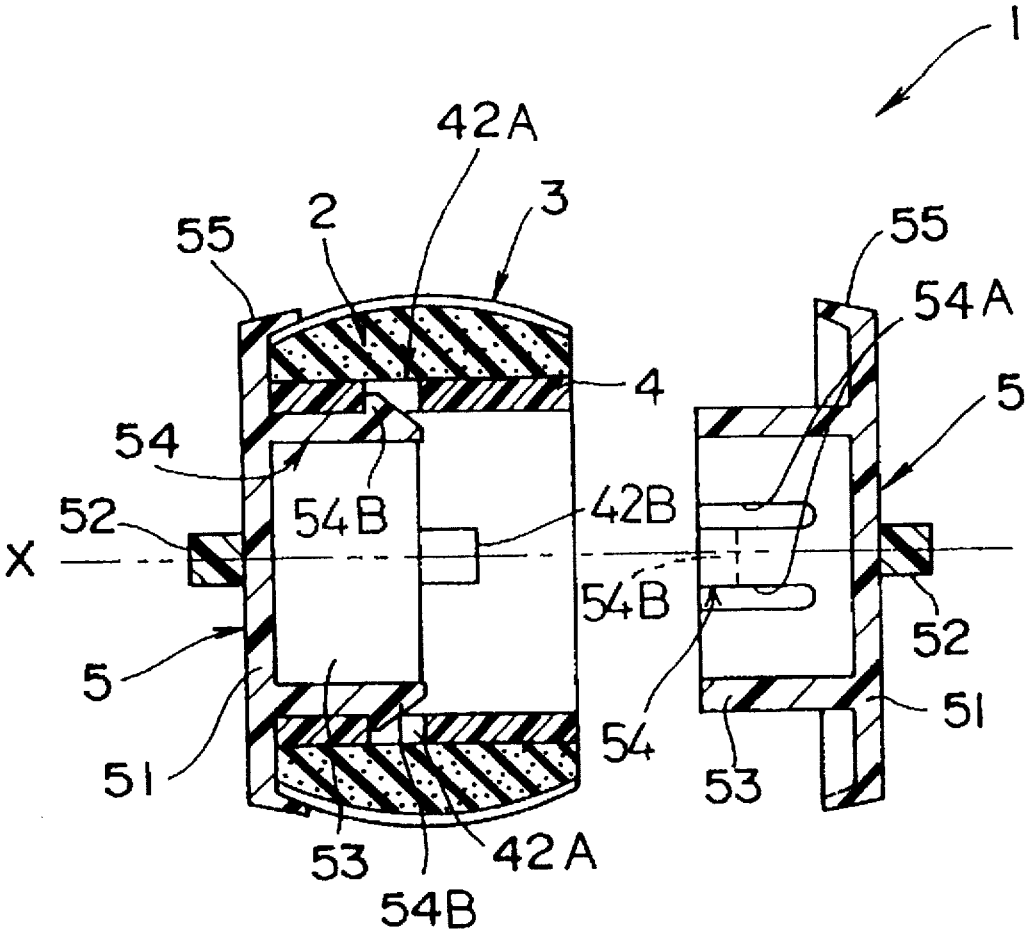
FIG. 3 is a side sectional view showing the structure of the cylindrical stamp in FIG. 1.

FIG. 3 is a side sectional view of the cylindrical stamp 1. As shown by FIG. 3, each of the cap members 5 is the same and comprises a circular disk portion 51, a support shaft 52 protruding from the disk portion 51 and a cylindrical portion 53 protruding from the disk portion 51 to the side thereof opposed to the support shaft 52. Each cylindrical portion 53 is inserted into the hollow portion of the ring-like member 4. The outer diameter of the cylindrical portion 53 is set to be slightly smaller than the inner diameter of the hollow portion of the ring-like member 4.

As shown by FIG. 1, a pair of slits 54A formed in parallel with each other in the longitudinal axis direction are respectively formed in the cylindrical portion 53 at two positions opposed to each other via the center of the cylindrical portion 53. A portion between the slits 54A constitutes an engaging claw 54 having an engaging portion 54B in a hook-like form at the front end thereof.

As illustrated in FIG. 3, two engaging holes 42A respectively for receiving the engaging portions 54B, which are provided at the front ends of the pair of engaging claws 54 of one of the cap members 5, are provided on the inner face of the hollow portion of the ring-like member 4 at positions opposed to each other via the central axis line X of the ring-like member 4. Similarly, two engaging holes 42B respectively for receiving the engaging portions 54B of the other cap member 5 are provided at positions opposed to each other via the central axis line X of the ring-like member 4. Incidentally, the pair of engaging holes 42A and the pair of engaging holes 42B are shifted from each other by 90° around the central axis line X of the ring-like member 4.

The pair of cap members 5 are attached to the ring-like member 4 by inserting the cylindrical portions 53 of the pair of cap members 5 into the hollow portion of the ring-like member 4 and by engaging the engaging portions 54B into the holes 42A and 42B.

A rim portion 55 protrudes from the face of the disk 51 to the same side as that of the cylindrical portion 53 and is integrally formed over the entire outer periphery of the disk 51 of the cap member 5. The rim portion 55 is provided to be inclined from the disk 51 such that the more remote from the disk 51, the larger the both inner diameter and outer diameter thereof. In other words, similar to the outer diameter of the ink impregnated body 2, the diameter of a portion of the rim portion 55 corresponding to the end portion of the ink impregnated body 2 is formed smaller than the diameter of a portion of the rim portion 55 corresponding to the central side in the width direction of the ink impregnated body 2.

The perforated stencil 3 is held in close contact with the ink impregnated body 2 by the disks 51 and the rim portions 55, with the cap members 5 being mounted to the ring-like member 4 and the engaging portions 54B being engaged with the engaging holes 42A and 42B.

The assembly of such a stamp portion 1 is carried out as follows. As shown in FIG. 1, the perforated stencil 3 is wrapped around the ink impregnated body 2 adherently fixed onto the ring-like member 4. Both ends of the perforated stencil 3 that is wrapped around the ink impregnated body 2 are adhered to each other, for example by an adhesive tape. It is preferable to previously impregnate ink into the ink impregnated body 2 before wrapping the perforated stencil 3.

Successively, the cap members 5 are inserted into the ring-like member 4 from both sides in the axial X direction. At this moment, as shown by FIG. 3, both ends in the axial direction of the perforated stencil 3 are held in close contact with the ink impregnated body 2 by the rim portions 55 of the cap members 5. Thereby, ink is prevented from leaking from the side faces of the ink impregnated body 2.

Figure 4:
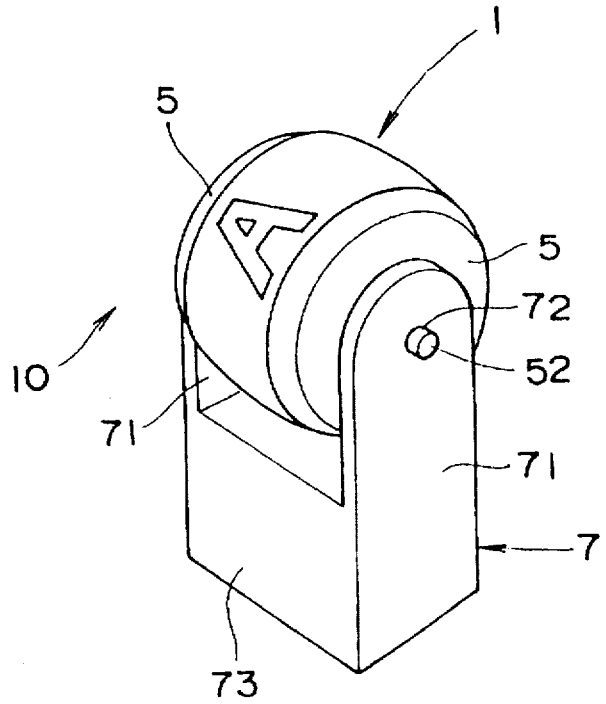
FIG. 4 is a perspective view showing a cylindrical stamp device using the stamp in FIG. 1.
Figure 5:
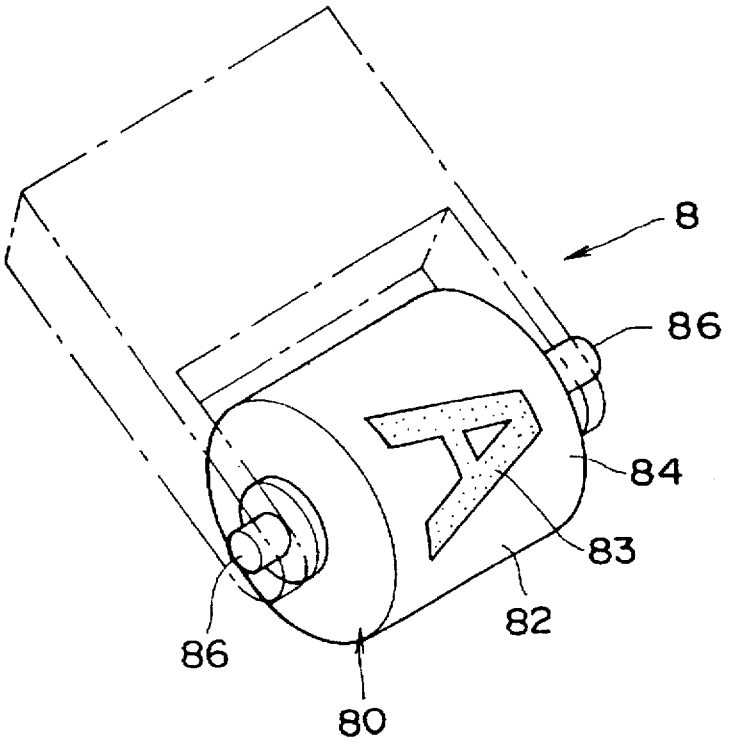
Fig.5 PRIOR ART
FIG. 5 is a perspective view showing a conventional cylindrical stamp.

FIG. 4 is a view showing a stamp device 10 using the above-mentioned stamp portion 1. The stamp device 10 is formed by the stamp portion 1 and a holding portion 7. A pair of support plates 71 are formed integrally with a main body portion 73 of the holding portion 7. Insertion holes 72 for receiving the support shafts 52 respectively formed at the cap members 5 are formed in the pair of support plates 71. The holding portion 7 rotatably holds the stamp portion 1 by receiving the support shaft 52 of the stamp portion 1 into the insertion holes 72.

As described above, according to the stamp portion 1 of this embodiment, the ink impregnated body 2 is provided on the outer peripheral face of the ring-like member 4, the perforated stencil 3 is wrapped around the ink impregnated body 2 and the cap members 5 are attached to the ring-like member 4 from both axial ends. By this, the perforated stencil 3 is securely held on the ink impregnated body 2. Consequently, the cylindrical stamp can be simply fabricated.

When the pattern for stamping is to be exchanged, only the perforated stencils 3 are interchanged, with the ink impregnated body 2, the ring-like member 4 and the cap members 5 utilized as are. That is, a new cylindrical stamp can be created by exchanging only the perforated stencil 3.

Furthermore, the ink impregnated body 2 is provided with a so-called bulged shape in which the diameter is maximized at the central portion and the diameter is minimized at the both end portions in the width direction. Accordingly, stamping is conducted with no interference of the rim portions 55, which hold the perforated stencil 3 into close contact with the ink impregnated body 2. When the stamp 10 is pressed onto recording paper, the ink impregnated body 2 is sufficiently compressed and a sufficient amount of ink oozes out, resulting in a clear image with no defects.

While advantageous embodiments have been chosen to illustrate the invention, it will be understood by those skilled in the art that various changes and modifications can be made therein without departing from the scope of the invention as defined in the appended claims.

What is claimed is:

1. A cylindrical stamp comprising:

a cylindrical shaft having an outer periphery;

a porous body adapted to be impregnated with ink provided around the outer periphery of the shaft, the porous body having side edges;

a perforated stencil provided around the porous body having an ink permeable portion that permits ink to permeate therethrough and an ink impermeable portion that prohibits ink from permeating therethrough; and a pair of cap members secured to the shaft, wherein each cap member abuts the side edges of the porous body and overlaps an edge of the perforated stencil.

2. The cylindrical stamp as claimed in claim 1, wherein each cap member is detachably secured to the shaft.

3. The cylindrical stamp as claimed in claim 1 wherein each cap member seals the side edges of the porous member so that ink cannot seep from the side edges of the porous member.

4. The cylindrical stamp as claimed in claim 1, wherein each cap member is circular with an outer periphery and has a flared rim portion extending generally axially outward for holding the side edges of the porous body and the perforated stencil.

5. The cylindrical stamp as claimed in claim 1, wherein each cap member has an outwardly extending support shaft adapted for rotatable engagement with a handle.

6. The cylindrical stamp as claimed in claim 1, wherein the shaft is hollow and each cap member has an outer face and an inner face with a cylindrical portion extending from the inner face configured to fit axially within the hollow shaft.

7. The cylindrical stamp as claimed in claim 6, wherein the shaft has a plurality of engaging formations therein and each cylindrical portion has at least one engaging member that releasably engages one of the engaging formations.

8. The cylindrical stamp as claimed in claim 7, wherein each cylindrical portion has at least one pair of axially extending slots and the engaging member is formed between the pair of slots such that the engaging member is flexible in a radial direction.

9. The cylindrical stamp as claimed in claim 7, wherein the engaging formations are engaging holes and the engaging members are engaging hooks.

10. The cylindrical stamp as claimed in claim 7, wherein the engaging formations are positioned at equal radially spaced intervals around the shaft.

11. The cylindrical stamp as claimed in claim 1, wherein the porous body is impregnated with ink.

12. The cylindrical stamp as claimed in claim 1, wherein the porous body has a maximum central diameter and wherein a diameter of the side edges is less than the maximum central diameter such that the porous body is barrel shaped.

13. The cylindrical stamp as claimed in claim 1, wherein the perforated stencil comprises a thermoplastic film attached to a fibrous supporter.

14. A rotatable stamp assembly comprising:

a hollow cylindrical shaft;

an ink impregnated body secured around the hollow cylindrical shaft;

a removable stencil member having a perforated image pattern formed therein; and a pair of end caps snap fit into the hollow cylindrical shaft having peripheral edges that overlap and secure the stencil member onto the ink impregnated body sealing the ink impregnated body onto the hollow cylindrical shaft.

15. The rotatable stamp assembly of claim 14 wherein the ink impregnated body is barrel shaped with an increased central diameter.

16. The rotatable stamp assembly of claim 14 wherein each end cap has an inwardly extending cylindrical protruding portion with an engaging formation thereon that snaps into the hollow cylindrical shaft.

17. A method of making a stamp for forming an image comprising the steps of:

providing a cylindrical hollow shaft;

securing a flexible porous member around the shaft, wherein the flexible porous member is adapted to be impregnated with ink;

providing a perforated stencil having an ink permeable portion and an ink impermeable portion representative of the image to be stamped;

wrapping the perforated stencil around the flexible porous member; and attaching end caps to the cylindrical shaft such that the end caps cover side edges of the flexible porous member and perforated stencil.

18. The method of claim 17 further comprising the step of impregnating the flexible porous member with ink.

19. The method of claim 18 further wherein the step of impregnating the flexible porous member with ink occurs prior to wrapping the perforated stencil around the porous member.

20. The method of claim 17 wherein the step of attaching the end caps includes snap fitting one of the end cap into each end of the cylindrical shaft.

21. The method of claim 17 wherein the step of providing the perforated stencil includes the steps of heat treating a thermoplastic film to create an image pattern for stamping.

22. The method of claim 17 further comprising the steps of removing the end caps and replacing the perforated stencil with a perforated stencil having a different image pattern thereon.

* * * * *